US006154984A

United States Patent [19]

Adam

[11] Patent Number: 6,154,984

[45] Date of Patent: Dec. 5, 2000

[54] GOLF SHOE CLEAT

[76] Inventor: John M. Adam, 818 Colston Rd. Dr., Marietta, Ga. 30033

[21] Appl. No.: 09/337,001

[22] Filed: Jun. 28, 1999

Related U.S. Application Data

[63] Continuation-in-part of application No. 09/083,799, May 22, 1998, Pat. No. 5,926,980.

[51] Int. Cl.[7] ..... A43B 23/28; A43B 5/00; A43C 15/00

[52] U.S. Cl. ..... 36/134; 36/67 D; 36/59 B; 36/62; 36/127

[58] Field of Search ..... 36/134, 67 R, 36/67 A, 67 D, 59 R, 59 B, 62, 65, 64, 61, 126, 127, 34 A; D2/947

[56] References Cited

U.S. PATENT DOCUMENTS

| | | |
|---|---|---|
| 2,235,774 | 3/1941 | Pierce et al. . |
| 2,689,417 | 9/1954 | Bernstein . |
| 3,055,125 | 9/1962 | Ronci . |
| 3,267,593 | 8/1966 | Turner . |
| 3,321,850 | 5/1967 | Coker et al. . |
| 3,566,489 | 3/1971 | Morley . |
| 3,715,817 | 2/1973 | White et al. . |
| 5,768,809 | 6/1998 | Savioe . |
| 5,901,472 | 5/1999 | Adam . |
| 5,926,980 | 7/1999 | Adam . |
| 5,960,568 | 10/1999 | Bell et al. . |
| 5,964,048 | 10/1999 | Shich . |

*Primary Examiner*—Paul T. Sewell
*Assistant Examiner*—Anthony Stashick
*Attorney, Agent, or Firm*—Harry I. Leon; Vivian L. Steadman

[57] ABSTRACT

A three-piece cleat assembly for use on athletic shoes which have, embedded in their soles, an interlocking receptacle, such as that used in the Q-LOK ® system. Molded of plastic, the cleat assembly includes a connector, a traction-enhancing member and a T-shaped member. The latter includes a stem from one end of which arms project outwardly. Distal from these arms, the stem is bifurcated into two branches. During assembly, the stem of the T-shaped member is inserted through a center hole in the traction-enhancing member; and the branches are squeeze-fitted into et square bore within the connector. Upon being released, the branches spring apart, pressing against the connector. Simultaneously, the arms nest snugly within troughs formed in the base of the traction-enhancing member; and a barb on the tip of each branch is caught on a shoulder rimming the square bore. To affix the cleat assembly, one simply inserts a trifurcated element on one end of the connector into the embedded receptacle and then rotates the connector through about 60 degrees. When rotation is complete, leaf spring-type fingers on the trifurcated element re-extend themselves, fitting into pockets in the receptacle and locking the connector in position. The traction-enhancing member includes arcuate-shaped, tapered ridges arrayed generally concentrically about the center hole. In use, the traction-enhancing member is mounted so that the thickest part of each ridge is closest to the shoe. As the ridges flex, mud picked up by the cleats becomes dislodged.

14 Claims, 5 Drawing Sheets

GOLF SHOE CLEAT

CROSS-REFERENCE TO RELATED APPLICATION

This application is a continuation-in-part of my pending U.S. patent application, Ser. No. 09/083,799, filed May 22, 1998, now U.S. Pat. No. 5,926,980.

FIELD OF INVENTION

This invention relates generally to golf shoes, and more particularly to releasably mounted cleats for the soles and/or heels of such shoes, for use in situations in which improved traction for the wearer is desirable.

BACKGROUND OF THE INVENTION

Damage to golf greens, as well as to the wooded floors and carpets of golf clubhouses, caused by golfers wearing athletic shoes with metal spikes is a well-known phenomenon. In response to consumer demand, shoe manufacturers have begun to provide golf shoes having non-metallic cleats.

In the applicant's earlier pending U.S. patent application, there is disclosed a removably mounted, two-piece cleat assembly for use with golf shoes. This cleat assembly comprises a pair of interlocking components, each of which is preferably molded of plastic. The paired components include a base and a T-shaped member having a threaded stem for threadedly engaging a bore or boss in the sole of a shoe. Distal from the tip of the threaded stem, the T-shaped member terminates in a plurality of arms which extend perpendicularly therefrom.

The base itself in the applicant's earlier combination defines a center hole and a plurality of channels extending radially therefrom for receiving the threaded stem and the arms, respectively, of the T-shaped member. In use, this threaded stem, inserted through the center hole of the base, holds it, the T-shaped member, and the shoe in assembled relation.

The base further defines a generally flat disk-shaped surface from which a plurality of arcuate-shaped ridges, Arranged in generally concentric circles, project downwardly to provide traction. In the preferred embodiment, the ridges are arrayed or grouped in a pattern which is subdivided into four quadrants by the channels. An arcuate-shaped trough appear,; between concentric ridges within each quadrant and communicates, at its distal ends, with a pair of the channels. For added strength, the innermost ridge in each quadrant is buttressed by an inwardly directed support, which terminates at the center hole.

The mounting of the cleat assembly is achieved by inserting the threaded stem into the center hole in the base, in such a way that the plurality of arms of the T-shaped threaded member nest snugly within radially extending depressions formed in the channels, then threadably engaging the threaded stem with a selected threaded bore or boss in a shoe. A simple hand tool, such as a Phillips or flat head screwdriver, can be used to facilitate this mounting operation. To replace a cleat assembly, one merely disengages its T-shaped threaded member from the shoe, exchanges the old base for a new one, and mounts it on the shoe with either the same or another T-shaped threaded member.

The prior art includes U.S. Pat. No. 5,768,809, which issued Jun. 23, 1998, to Savoie. He discloses a quick release spike, fabricated of plastic with a metal core, for use on footwear. Now marketed by Champ as the Q-LOX ® system, Savoie's combination utilizes a receptacle having an opening formed in its bottom surface for receiving a connecting element on the cleat or spike. This opening, which in plan view has threefold symmetry, is sized to slideably receive the connecting element. In transverse cross-section, this connecting element has three extensions, arranged in a pattern which complements the receptacle opening. Communicating with this opening is a chamber within the receptacle which extends generally perpendicularly from the centerline of the opening. The chamber itself is divided into three pockets by shoulders which protrude inwardly.

Immediately upon its being been inserted into the receptacle, the connecting element is in a position from which it can be rotated, but only in one direction. This rotation can occur through an angle of approximately 60 degrees about the centerline of the receptacle opening. As the connecting element is so rotated, each extension thereon becomes wedged against a ramp-like section on one of the shoulders. Simultaneously, a leaf spring-like finger, which initially extends slightly inwardly toward the receptacle opening, is pushed out of the way, allowing the extension contiguous with the finger to be rotated past it. Ultimately, each finger re-extends itself, with the result that greater torque must be applied to remove the cleat than to install it. A special tool must be used to install or remove Savoie's quick release cleat.

SUMMARY OF THE INVENTION

The primary object of the present invention is to provide an improved, removably-mounted cleat assembly for use with golf shoes, which is also comfortable to wear.

Another object of the present invention is to provide an improved cleat assembly with a self-cleaning cleat.

A further object of the present invention is to provide, in an improved cleat assembly, means for slideably engaging an open receptacle mounted in the sole of a shoe, in such a way that dirt, water and other contaminants that might jam the receptacle are sealed out, thereby making the shoe easier to maintain.

A still further object of the present invention is to provide an improved cleat assembly with a dual locking means to securely lock the cleat in the receptacle.

A still further object of the present invention is to provide an improved cleat assembly in which the cleat can be installed or removed with the use of an ordinary flat blade screwdriver.

A still further object of the present invention is to provide an improved cleat assembly in which the cleat need not be reinforced by a metal core, thus making the cleat easier and less costly to manufacture.

In accordance with the present invention, there is provided an improved cleat assembly having a set of interlocking components, including a T-shaped member, a traction-enhancing member and a connector. The traction-enhancing member is molded of pliable polyvinyl chloride or a similar plastic. Like the base in the cleat assembly described in the applicant's pending U.S. patent application, the traction-enhancing member has a generally flat disk-shaped surface from which a plurality of arcuate-shaped ridges project downwardly. These ridges are tapered in such a way that spaces between them open towards the tip of the ridges.

This traction-enhancing member, with its ridges so formed, not only is comfortable to walk on, even on a hard surface, but also is self-cleaning. As weight is applied to the improved cleat assembly, the ridges flex; and any trapped mud caught in the troughs is soon freed.

Like the quick release cleat taught by Savoie, in U.S. Pat. No. 5,768,809, the connector in the improved cleat assembly is slideably engageable with one of a plurality of open receptacles mounted in the soles and heels of certain athletic shoes. Specifically, the connector includes a receptacle-engaging means which can be slip-fitted into a Q-LOK ® receptacle and then locked therein by rotating the connector about its centerline. Three leaf spring-type fingers projecting from the outer periphery of the receptacle-engaging means are utilized to supplement the locking action. Each of these fingers is pressed, as the connector is being rotated, into one of three pockets defined by the Q-LOK ® receptacle. Once the connector has been fully rotated, these fingers re-extend themselves and interact, like barbs, with shoulders in the receptacle, making it more difficult to remove the cleat assembly than to install it.

In addition, the connector has a slightly concave flange which extends laterally and upwardly from beneath the receptacle-engaging means. The flange not only provides for additional contact surface between the receptacle and connector, helping to prevent rotation of the latter within the receptacle but also the flange covers the Q-LOK ® receptacle and seals it against dirt.

The third interlocking component in the improved cleat assembly, the T-shaped member, includes a stem and a plurality of arms which extend generally perpendicularly from the lower end thereof. In assembled relation, the stem and arms fit, respectively, into a center hole and channels within the traction-enhancing member. Distal from the arms, the stem is bifurcated, terminating in a pair of branches. The branches comprise means for engaging internal walls of the connector which define a centrally-located square bore.

Means for locking the T-shaped member in position relative to the connector includes a pair of barbs, each barb being disposed on one of the branches. By squeeze-fitting the branches into the square bore, the stem can be fully inserted therein, allowing the barbs to catch on shoulders which rim the upper edges of the square bore. Once the branches are released, they spring apart, pressing against the connector walls, and lock the T-shaped member, the traction-enhancing member and the connector together as one unit.

DETAILED DESCRIPTION OF THE PREFERRED EMBODIMENT

Figures 1, 2:
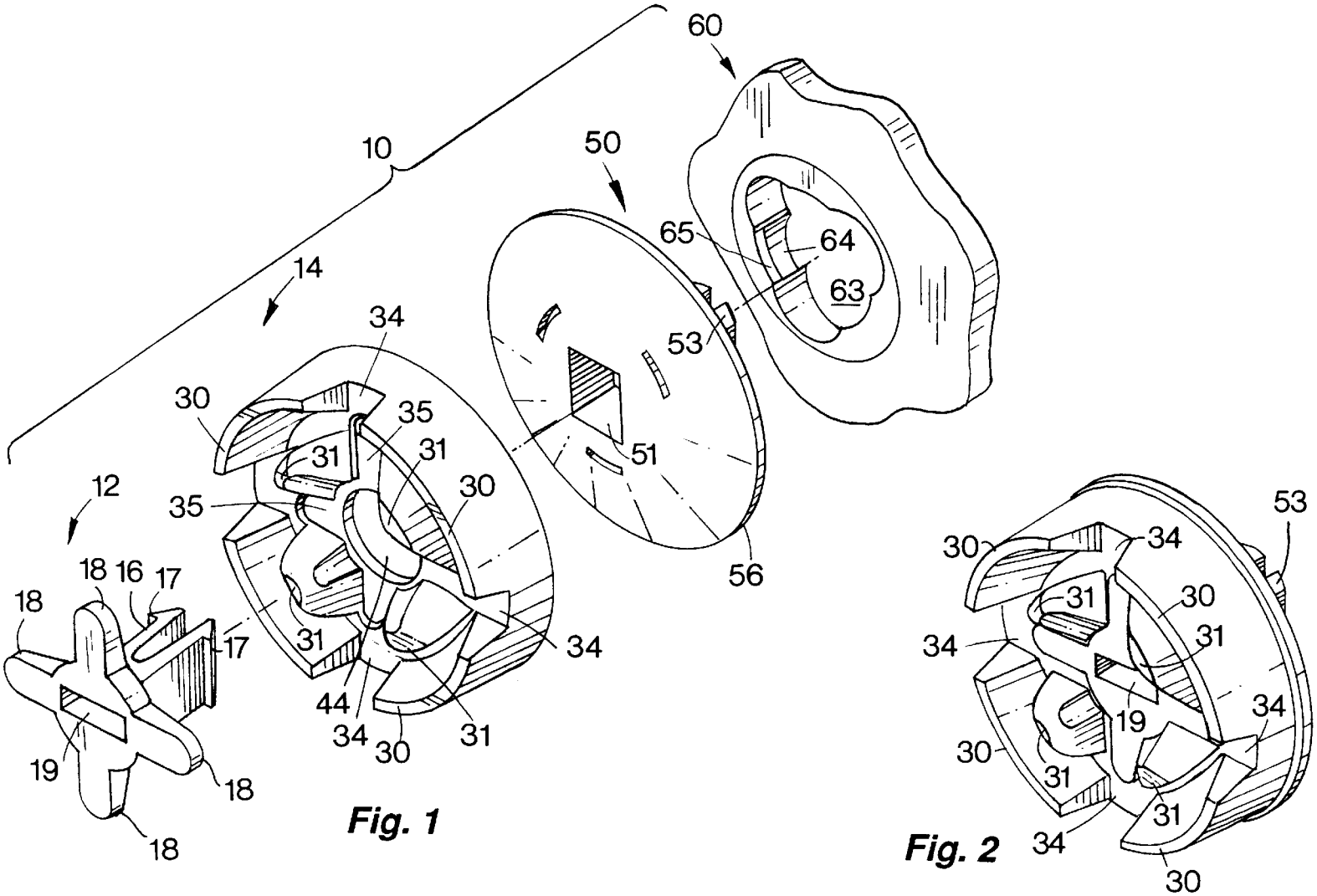
FIG. 1 is an exploded frontal perspective view of the three-piece cleat assembly according to the present invention and of a Q-LOK ® system receptacle mounted on a fragmentary portion of a shoe, the receptacle being shown for illustrative purposes only and forming no part of the invention.
FIG. 2 is a frontal perspective view of the three-piece cleat assembly according to FIG. 1 in assembled relation.
Figure 3:
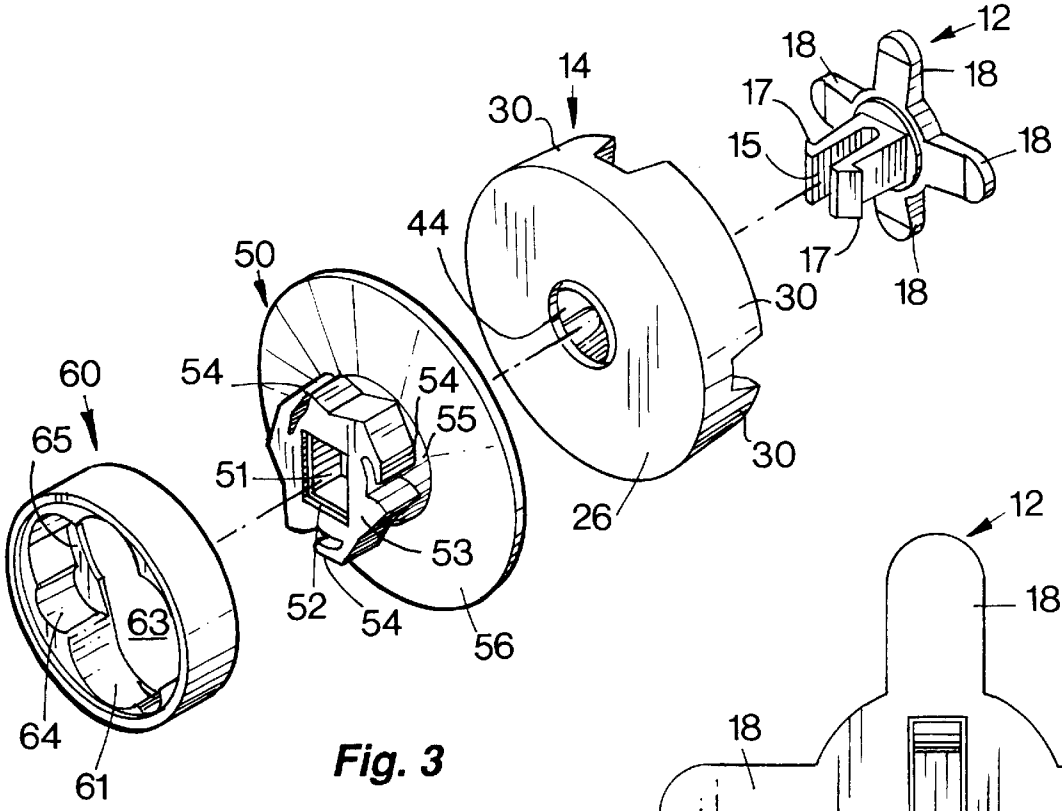
FIG. 3 is an exploded rear perspective view of the cleat assembly according to FIG. 1.
Figure 4:
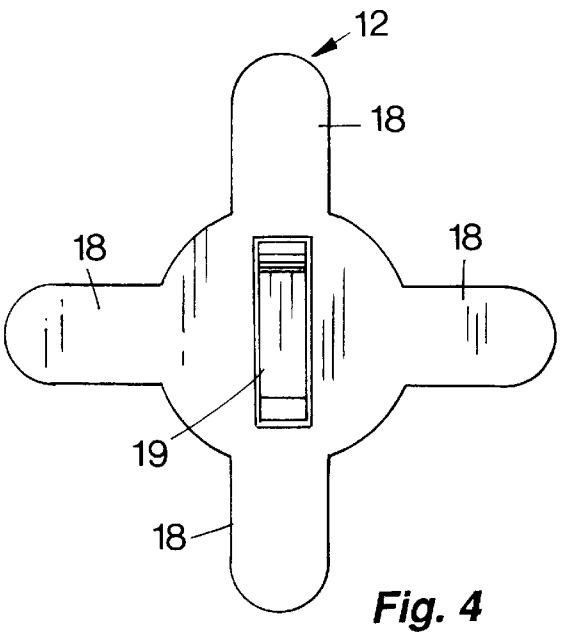
FIG. 4 is the bottom plan view of a T-shaped member, one of three interlocking pieces in the cleat assembly according to FIG. 1.

Referring now to the drawings, an improved cleat assembly is indicated generally by the reference numeral 10. The cleat assembly 10 comprises three interlocking components including a T-shaped member 12, a traction-enhancing member, 14, and a connector 50, each of which is a single, unitary piece molded from a plastic material. The traction-enhancing member 14 is preferably fabricated from a pliable polyvinyl chloride having a hardness in the range of 80 to 85 durometers with 85A preferred. Both the T-shaped member 12 and the connector 50, on the other hand, are preferably made of a more rigid plastic such as nylon.

Figure 7:
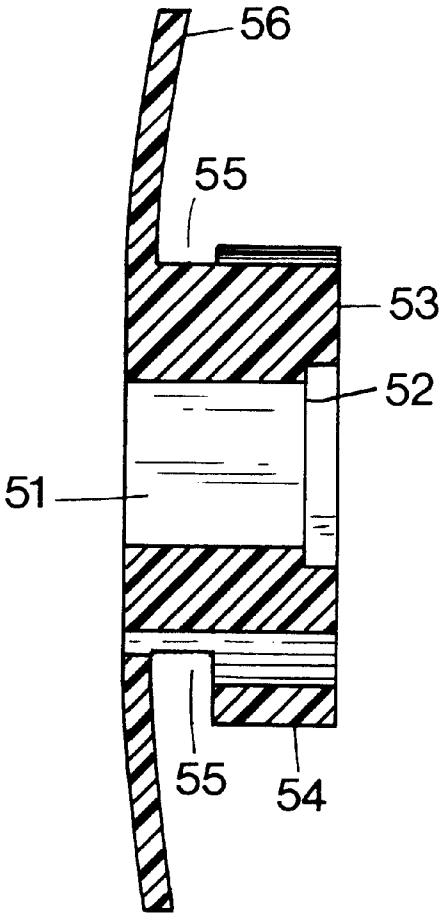
FIG. 7 is a cross-sectional view taken along line 7—7 of the connector according to FIG. 6.
Figure 6:
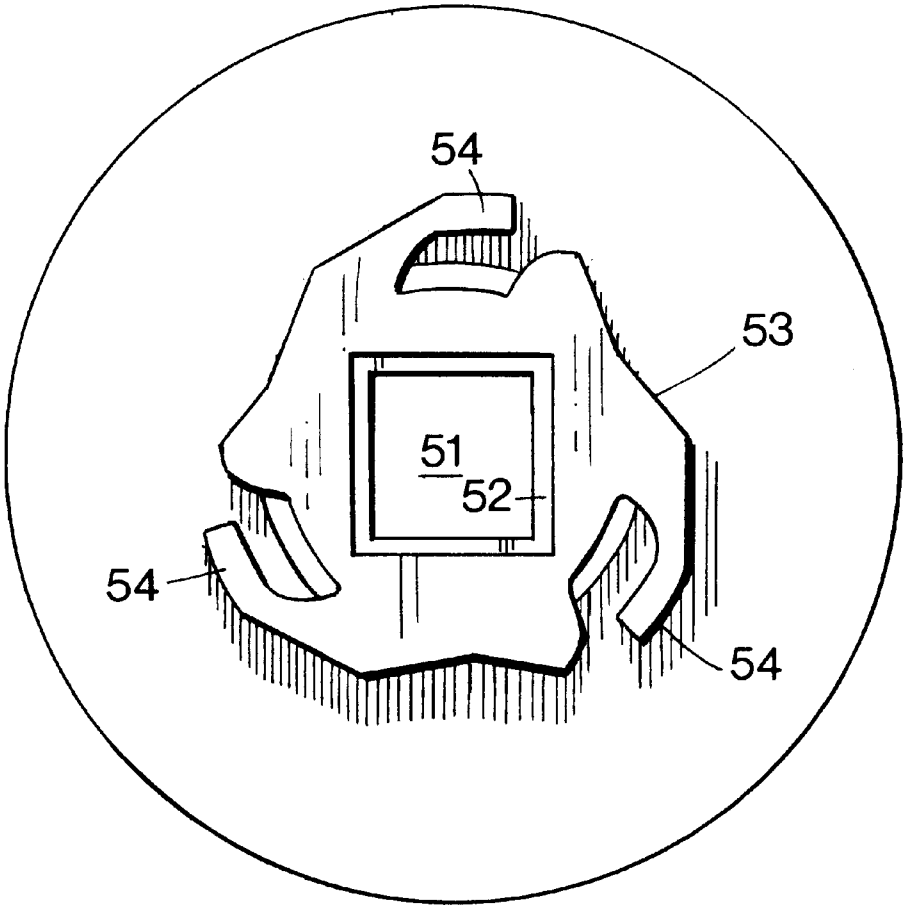
FIG. 6 is a top plan view of a connector, ore of three interlocking pieces in the cleat assembly according to FIG. 1.
Figure 10:
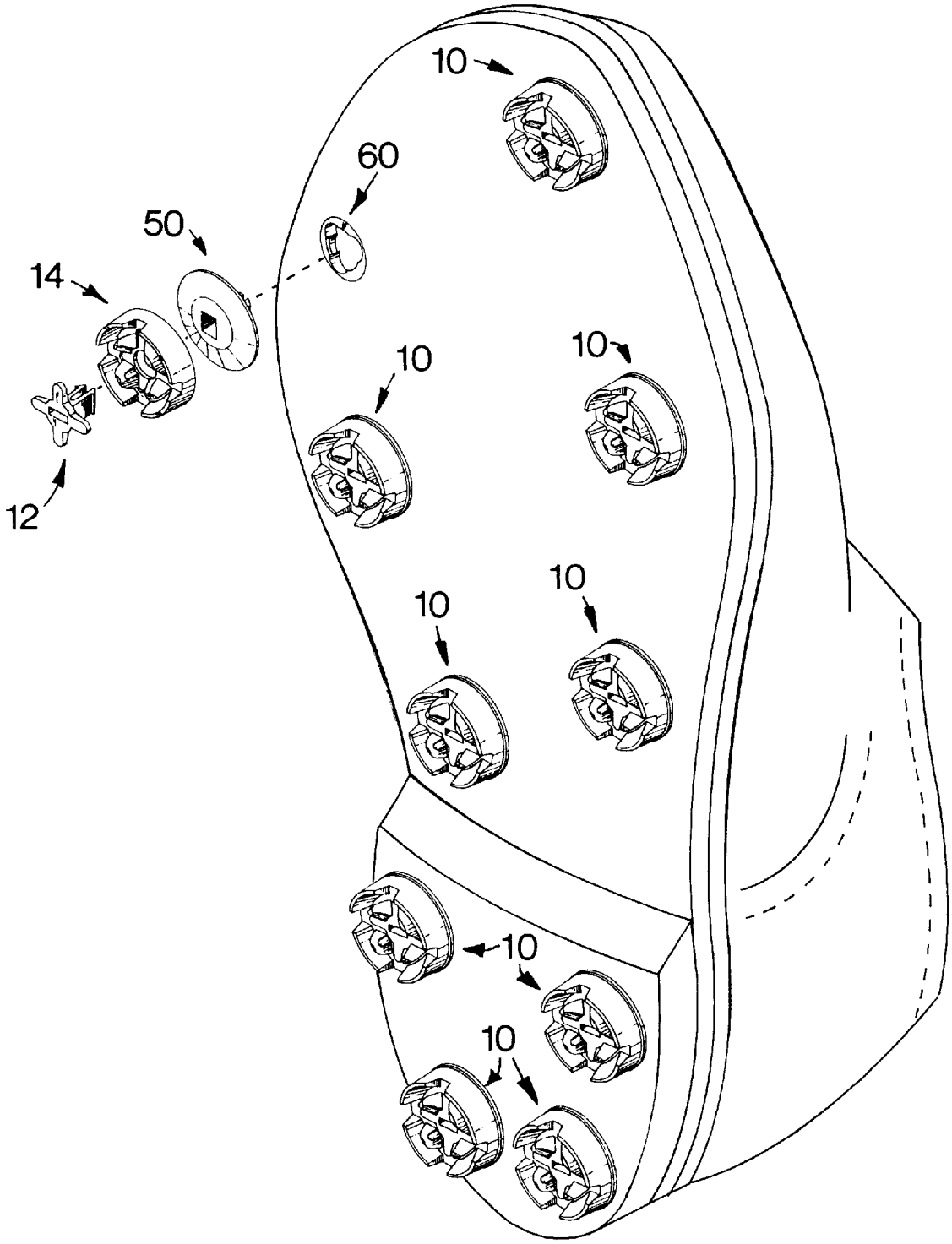
FIG. 10 is a bottom perspective view of the sole of a athletic shoe with the all of its cleats being installed except one, each cleat having a traction-enhancing member in a three-piece cleat assembly according to the present invention, the shoe and a Q-LOK ® system receptacle mounted thereon being shown for illustrative purposes only and forming no part of the invention.

As is illustrated in FIG. 10, the connector 50 in the improved cleat assembly 10 is slideably engageable with one of a plurality of open receptacles 60 mounted in the sole and heel of an athletic shoe. The connector 50 itself defines a square bore 51, which is rimmed along each of its upper edges by a shoulder 52 (FIGS. 6 and 7).

Figure 5:
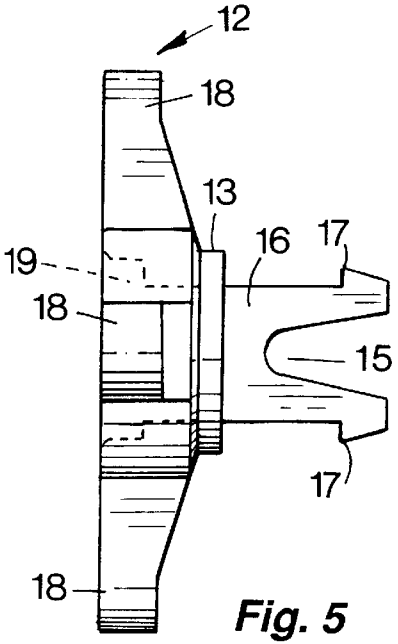
FIG. 5 is a side view of the T-shaped member according to FIG. 4.
Figure 9:
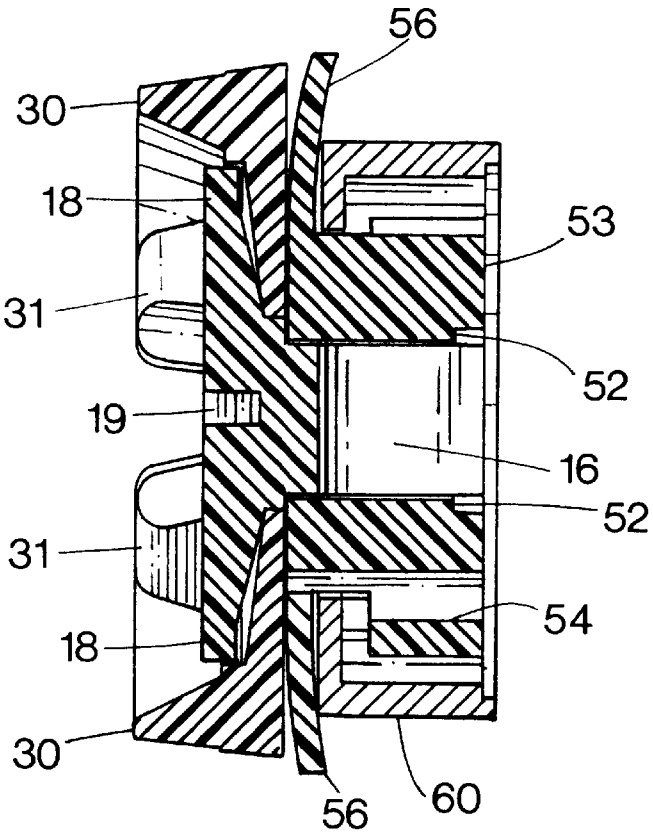
FIG. 9 is a cross-sectional view of the cleat assembly according to FIG. 1 interlocked with a Q-LOK ® system receptacle.

In the T-shaped member 12, a plurality of arms 18, which in the preferred embodiment number four, extend perpendicularly from the bottom of a bifurcated stem 16 (FIG. 1). Disposed on the stem 16 between a pair of branches which define a U-shaped cutout 15 and the arms 18 is a round neck 13 which is sized to slideably fit a center hole 44 in the traction-enhancing member 14 (FIGS. 5 and 9).

Distal from the arms 18, each of the branches terminates with a locking barb 17. Squeeze-fitted into the square bore 51, the branches can be inserted sufficiently far therein to catch the barbs 17 on a pair of shoulders 52 (FIG. 9). The, barbs 17 lock in place when the branches are released and spring apart, pressing against the connector walls.

Means for rotating the cleat assembly 10 in the receptacle 60, so that the cleat assembly can be installed therein or removed therefrom, includes the T-shaped member having a slot 19 formed in the bottom of the stem 16. Installatiion of the cleat assembly 10 is achieved by engaging a screw driver blade (not shown) with the sidewalls of slot 19.

Means for affixing the cleat assembly 10 to certain athletic shoes comprises at least one Q-LOK ® receptacle 60 mounted on the underside thereof and the connector 50 (FIG. 10). Preferably trifurcated, the connector 50 includes a main body 53 and leaf spring-type fingers 54, which project from the cuter periphery thereof (FIG. 6). Prior to affixing the assembly 10, the main body 53 and fingers 54 must first be slip-fitted through a triform opening 63 in the receptacle 60 (FIG. 1). Once inside the receptacle 60, the main body 53 is rotated clockwise, about the centerline of the connector 50, through an angle of approximately 60 degrees until the connector is locked into position. Sidewalls 61, against which the fingers 54 press as the connector 50 is being rotated relative to the receptacle 60, force the fingers, which project from the outer periphery of the main body 53, to move into closer contact with it (FIG. 6). After the connector 50 has been fully rotated, these fingers 54 re-extend themselves into pockets 64, each pocket being disposed above a lip 65 in the receptacle 60 (FIGS. 1, 6 and 7). Like barbs, the fingers 54 interact with walls defining the pockets 64 (FIG. 9). The locking action provided by this interaction requires one to apply greater torque to remove the cleat assembly 10 than to install it.

In addition, the connector 50 has a slightly concave flange 56 which extends laterally from beneath the trifurcated element 53 and is separated therefrom by a groove 55 (FIG. 7). The lip 65 is sufficiently thick that when it is received within the groove 55, the connector 50 cannot be pulled out of the receptacle 60 from the locked position (FIGS. 7 and 9). Moreover, the flange 56 covers the Q-LOK ® receptacle 60 and seals it against dirt (FIG. 9).

Figure 8:
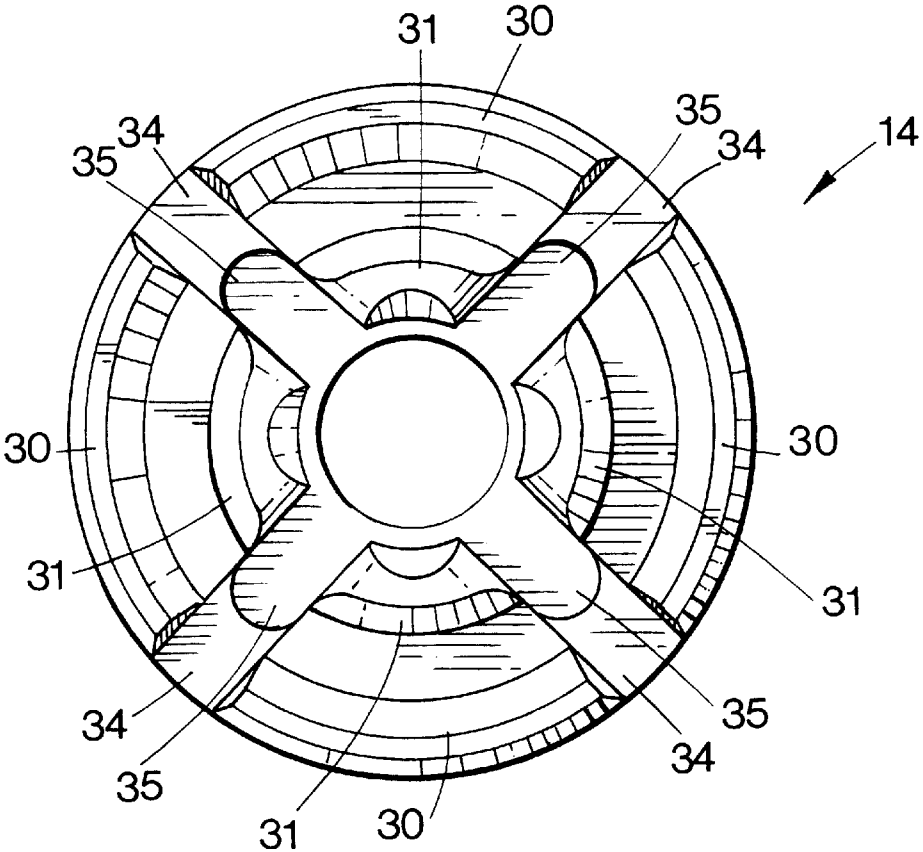
FIG. 8 is a bottom plan view of a traction-enhancing member in the cleat assembly according to FIG. 1.

In the improved cleat assembly 10, the traction-enhancing member 14 includes a disk-shaped base from which a plurality of arcuate-shaped ridges 30, 31 project downwardly (FIGS. 1 and 8). The base, across its upper, generally-flat surface, measures, by way of example, about ⅞ inch in diameter and has a center hole 44 which is approximately ¼ inch in diameter.

As illustrated in FIG. 8, the ridges 30, 31 are preferably arrayed in a pattern with fourfold symmetry. Dividing the ridges 30, 31 into four quadrants are channels 34. Between each pair of proximate ridges 30, 31 is an open space which communicates with two of the channels 34. The ridges 30, 31 ore tapered in such a fashion that they decrease in transverse cross-section downwardly, enhancing self-cleaning (FIG. 8). In the preferred embodiment, each ridge 30, 31 includes a concave sidewall and a convex sidewall (FIGS. 1, 2 and 8). Each ridge 30, 31 increases in transverse cross-section from its tip to the base, with the convex sidewall being tapered less relative to the centerline of the traction-enhancing member 14 than is the concave sidewall (FIGS. 8 and 9). In use, as weight is applied to the improved cleat assembly 10, the ridges 30, 31 flex, freeing any trapped mud caught in the troughs 35. Sunken within each channel 34, at a depth which is approximately equal to the thickness of an arm 18, is a trough 35 which radiates outwardly from the center hole 44 (FIG. 8). In assembled relation, the stem 16 and arms 18 of the T-shaped member 12 fit snugly into the center hole 44 and troughs 35, respectively, within the traction-enhancing member 14 (FIGS. 2 and 9). Simultaneously, distal from the arms 18, a pair of barbs 17 on branches of the bifurcated stem 16 engage two shoulders 52 at the upper edges of a centrally-located square bore 51 within the connector 50 (FIGS. 6 and 9). Squeeze-fitted into the square bore 51, the branches spring apart when released, pressing against inner walls of the connector 50 and insuring that the barbs 17 remain caught on the shoulders 52.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A cleat assembly adapted for interlocking with a receptacle mounted on an athletic shoe, said cleat assembly comprising:

(a) a T-shaped member having a stem and a plurality of arms projecting perpendicularly thereto, an end of the stem distal from the arms having two branches;

(b) a base having a center hole and first and second faces, the first face being generally smooth; the second face having a plurality of arcuate-shaped ridges which project in a direction away from the first face and which are disposed generally concentrically about the center hole; and (c) a connector which has a centrally-located opening into which the two branches of the T-shaped member can be squeeze-fitted; in assembled relation, a portion of the base contiguous with the center hole being juxtaposed between the arms of the T-shaped member and the connector, the stem of the T-shaped member extending through the center hole of the base and into the centrally-located opening of the connector.

2. The cleat assembly according to claim 1, wherein each arcuate-shaped ridge has a tip, a concave sidewall, and a convex sidewall; each sidewall being tapered in such a way that the ridge decreases in transverse cross-section from the second face to the tip.

3. The cleat assembly according to claim 1, wherein the connector includes a main body and plurality of fingers which extend laterally therefrom, each of the fingers being pushed into a retracted position against the main body as said body is being rotated in a first direction within the receptacle and then re-extending themselves once the body has been rotated in said first direction through about 60 degrees, so that a greater force must be applied to remove the connector than to install it.

4. The cleat assembly according to claim 3, wherein the connector includes a spring-loaded flange, the flange being spaced apart from the receptacle-engaging means, the flange extending perpendicularly to and laterally from its centerline, in such a way that when the receptacle-engaging means is installed in the receptacle, the flange covers the receptacle, sealing it so as to keep out dirt and other foreign matter.

5. A cleat assembly adapted for interlocking with a receptacle mounted on an athletic shoe, said cleat assembly comprising:

(a) a T-shaped member having a stem and a plurality of arms projecting perpendicularly thereto, an end of the stem distal from the arms having two branches;

(b) a base having a center hole and first and second faces, the first face being generally smooth; the second face having a plurality of arcuate-shaped ridges which project in a direction away from the first face and which are disposed generally concentrically about the center hole; the second face defining a plurality of channels which extend perpendicularly to the center hole, the channels being arrayed in such a way that the arms of the T-shaped member can be nested therein; and (c) a connector which has a centrally-located opening into which the two branches of the T-shaped member can be squeeze-fitted, the stem of the T-shaped member extending through the center hole of the base and into the centrally-located opening of the connector in assembled relation.

6. The cleat assembly according to claim 5, wherein at least two sets of arcuate-shaped ridges are disposed generally concentrically about the center hole, proximate ridges within the two sets being spaced apart radially.

7. The cleat assembly according to claim 5, wherein the channels which extend perpendicularly to the center hole lie along imaginary lines which subdivide the second face of the base into quadrants.

8. A cleat assembly adapted for interlocking with a receptacle mounted on an athletic shoe, said cleat assembly comprising:

(a) a T-shaped member having a stem and a plurality of arms projecting perpendicularly thereto, an end of the stem distal from the arms having two branches;

(b) a base having a center hole and first and second faces, the first face being generally smooth; the second face having a plurality of arcuate-shaped ridges which project in a direction away from the first face and which are disposed generally concentrically about the center hole; and (c) a connector which has a centrally-located opening into which the two branches of the T-shaped member can be squeeze-fitted, the stem of the T-shaped member extending through the center hole of the base and into the centrally-located opening of the connector in assembled relation; the connector having receptacle-engaging means and a flange spaced apart therefrom, the flange extending laterally from one end of the connector and being slightly concave in a direction towards the receptacle-engaging means, so that when the cleat assembly and the receptacle are interlocked, the flange presses against surfaces contiguous thereto on the athletic shoe.

9. In combination, an athletic shoe including a sole having a generally planar lower surface including an array of exposed receptacles, each receptacle having recessed pockets disposed symmetrically about a central through opening, and a plurality of traction-enhancing cleat assemblies, each cleat assembly having a connector, portions of which can be slip-fitted into said through opening, the connector having a plurality of fingers which extend laterally from the main body, each of the fingers being pushed into a retracted position against the main body as said body is rotated in a first direction within the receptacle and then extending themselves into proximate recessed pockets once the body has been rotated in said first direction through about 60 degrees, wherein the improvement comprises each cleat assembly having:

(a) a T-shaped member which includes a stem and a plurality of arms projecting perpendicularly thereto, an end of the stem distal from the arms having two branches;

(b) a base having a center hole and first and second faces, the first face being generally smooth; the second face having a plurality of arcuate-shaped ridges which project in a direction away from the first face and which are disposed generally concentrically about the center hole; and (c) the connector having a main body which defines a centrally-located opening into which the two branches of the T-shaped member can be squeeze-fitted; in assembled relation, a portion of the base contiguous with the center hole being juxtaposed between the arms of the T-shaped member and the connector, the stem of the T-shaped member extending through the center hole of the base and into the centrally-located opening of the connector.

10. In combination, an athletic shoe including a sole having an array of exposed receptacles, each receptacle having recessed pockets disposed symmetrically about a central through opening, and a plurality of traction-enhancing cleat assemblies, each cleat assembly having at connector, portions of which can be slip-fitted into said through opening, the connector having a plurality of fingers which extend laterally from the main body, each of the fingers being pushed into a retracted position against the main body as said body is rotated in a first direction within the receptacle and then extending themselves into proximate recessed pockets once the body has been rotated through about 60 degrees in said first direction, wherein the improvement comprises each cleat assembly having:

(a) a T-shaped member which includes a stem and a plurality of arms projecting perpendicularly thereto, an end of the stem distal from the arms having two branches;

(b) a base having a center hole and first and second faces, the first face being generally smooth; the second face having a plurality of arcuate-shared ridges which project in a direction away from the first face and which are disposed generally concentrically about the center hole; the second face defining a plurality of channels which extend perpendicularly to the center hole, the channels being arrayed in such a way that the arms of the T-shaped member can be nested therein; and (c) the connector having a main body which defines a centrally-located opening into which the two branches of the T-shaped member can be squeeze-fitted, the stem of the T-shaped member extending through the center hole of the base and into the centrally-located opening of the connector in assembled relation.

11. The cleat assembly in the combination according to claim 10, wherein at least two sets of arcuate-shaped ridges are disposed generally concentrically about the center hole, proximate ridges within the two sets being spaced apart radially.

12. The cleat assembly in the combination according to claim 10, wherein the channels which extend perpendicularly to the center hole lie along imaginary lines which subdivide the second face of the base into quadrants.

13. The cleat assembly ion the combination according to claim 10, wherein each actuate-shaped ridge has a tip, a concave sidewall, and a convex sidewall; each sidewall being tapered in such a way that the ridge decreases in transverse cross-section from the second face to the tip.

14. In combination, an athletic shoe including a sole having an array of exposed receptacles, each receptacle having recessed pockets diamond symmetrically about a central through opening, and a plurality of traction-enhancing cleat assemblies, each cleat assembly having a connector, portions of which can be slip-fitted into said through opening the connect having a plurality of fingers which extent laterally from the main body, each of the fingers being pushed into a retracted position against the main body as said body is rotated in a first direction within the receptacle and then extending themselves into proximate recessed pockets once the body has been rotated through about 60 degrees in said first direction, wherein the improvement comprises each cleat assembly having:

(a) a T-shaped member which includes a stem and a plurality of arms projecting perpendicularly thereto, an end of the stem distal from the arms having two branches;

(b) a base having a center hole and first and second faces the first face being generally smooth; the second face having a plurality of arcuate-shaped ridges which project in a direction away from the first face and which are disposed generally concentrically about the center hole; and (c) the connector having a main body which defines a centrally-located opening into which the two branches of the T-shaped member can be squeeze-fitted, the stem of the T-shaped member extending through the center hole of the base and into the centrally-located opening of the connector in assembled relation, the connector including a flange spaced apart from the fingers, the flange extending laterally from one end of the connector and being slightly concave in a direction towards the fingers, so that when the cleat assembly and the receptacle are interlocked, the flange presses against surfaces contiguous thereto on the athletic shoe.

* * * * *